US009492913B2

(12) United States Patent
Bonas et al.

(10) Patent No.: US 9,492,913 B2
(45) Date of Patent: Nov. 15, 2016

(54) APPARATUS FOR TIGHTENING THREADED FASTENERS

(75) Inventors: Calvin A. Bonas, Bronx, NY (US); Peter Koppenhoefer, Portland, PA (US)

(73) Assignee: HYTORC Division UNEX Corporation, Mahwah, NJ (US)

( * ) Notice: Subject to any disclaimer, the term of this patent is extended or adjusted under 35 U.S.C. 154(b) by 183 days.

(21) Appl. No.: 14/241,354

(22) PCT Filed: Aug. 26, 2012

(86) PCT No.: PCT/US2012/052420

§ 371 (c)(1), (2), (4) Date: Feb. 26, 2014

(87) PCT Pub. No.: WO2013/032963

PCT Pub. Date: Mar. 7, 2013

(65) Prior Publication Data

US 2014/0366689 A1 Dec. 18, 2014

Related U.S. Application Data

(60) Provisional application No. 61/527,989, filed on Aug. 26, 2011.

(51) Int. Cl.

| | |
|---|---|
| ***B25B 23/00*** | (2006.01) |
| ***B25B 13/46*** | (2006.01) |
| ***B25B 17/02*** | (2006.01) |
| ***B25B 21/00*** | (2006.01) |

(52) U.S. Cl.

CPC ..... *B25B 23/0078* (2013.01); *B25B 13/463* (2013.01); *B25B 17/02* (2013.01); *B25B 21/004* (2013.01)

(58) Field of Classification Search

CPC . B25B 23/0078; B25B 17/02; B25B 13/463; B25B 13/467; B25B 21/004; B25B 21/005

See application file for complete search history.

(56) References Cited

U.S. PATENT DOCUMENTS

| | | | | |
|---|---|---|---|---|
| 3,270,596 | A * | 9/1966 | Hall | B25B 21/002 74/116 |
| 3,564,953 | A * | 2/1971 | Able | B25B 21/004 74/118 |
| 4,200,011 | A * | 4/1980 | Wilmeth | B25B 23/0078 81/57.39 |
| 4,339,968 | A * | 7/1982 | Krieger | B25B 21/005 81/57.39 |

(Continued)

*Primary Examiner* — David B Thomas

(74) *Attorney, Agent, or Firm* — Justin B. Bender, Esq.

(57) ABSTRACT

A link attachment 100 for use with a device 300 for effecting an intermittent turning force 360 which oscillates in a forward and a backward direction 361 and 371 for tightening or loosening a fastener including: —a link housing 115; a link drive input 131 operatively connectable with device 300; a link drive lever 102 operatively connected with link drive input 131; a link drive plate 101 operatively connected to link drive lever 102 at a pivot point 125 by a link drive pin 105; a link ratcheting mechanism 103 operatively connected to link drive lever 102 by a drive pawl 104; a link attachment drive output 130 operatively connected with link ratcheting mechanism 103 and operatively connectable with the fastener; and link attachment 100 being operatively connectable to device 300 to provide intermittent turning force 360 to turn the fastener. Advantageously link attachment 100: is operatively connectable to device 300 either by itself or via a drive extension 200; limits the need for movable components in device 100; engages inaccessible fasteners; and magnifies and transfers intermittent turning force 360 to the fastener.

26 Claims, 2 Drawing Sheets

(56) References Cited

U.S. PATENT DOCUMENTS 4,429,597 A * 2/1984 Grabovac ..... B25B 23/0078 81/57.39
4,744,271 A * 5/1988 Collins ..... B25B 13/462 81/57.39
4,794,825 A * 1/1989 Schmoyer ..... B25B 23/0078 81/57.24
5,953,966 A * 9/1999 Spirer ..... B25B 13/463 81/57.3
6,148,694 A * 11/2000 Spirer ..... B25B 13/463 81/57.3
6,260,443 B1 * 7/2001 Spirer ..... B25B 13/463 81/57.3
6,912,933 B2 * 7/2005 Knopp ..... B23D 29/005 81/57.39
7,062,992 B2 * 6/2006 Spirer ..... B25B 13/463 81/57.3
7,082,858 B2 * 8/2006 Knopp ..... B23D 29/005 81/57.33

* cited by examiner

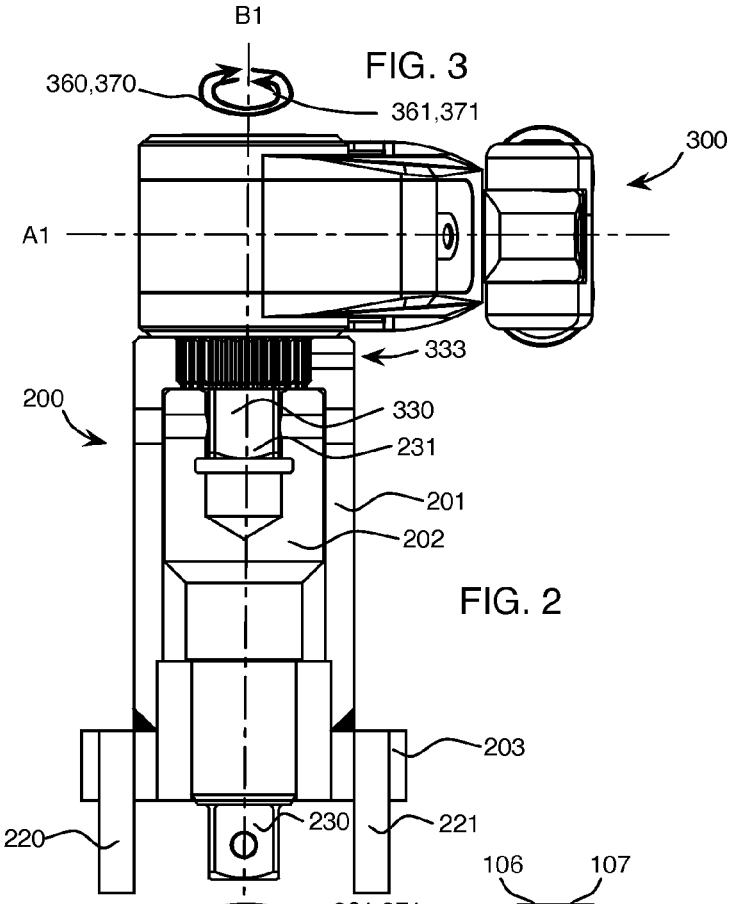
FIG. 3
FIG. 2
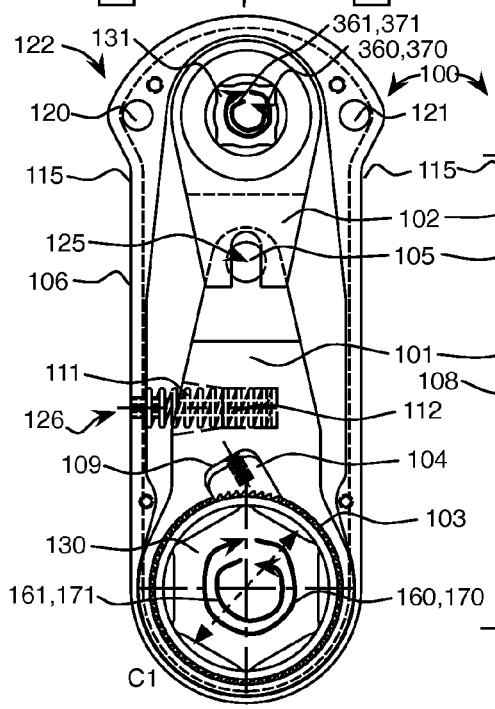
FIG. 1A
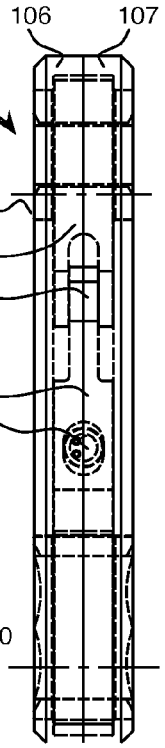
FIG. 1B

APPARATUS FOR TIGHTENING THREADED FASTENERS

CROSS REFERENCE TO RELATED APPLICATIONS

This Application is a continuation application of co-pending U.S. Application Ser. No. 61/527,989, having the Filing Date of 26 Aug. 2011, is entitled "APPARATUS FOR TIGHTENING THREADED FASTENERS", an entire copy of which is incorporated herein by reference.

Innovations disclosed in this Application advance technology disclosed in the following commonly owned issued patents, entire copies of which are incorporated herein by reference: U.S. Pat. No. 5,140,874, having Issue Date of 25 Aug. 1992, entitled "FLUID-OPERATED WRENCH"; and U.S. Pat. No. 7,451,672, having Issue Date of 18 Nov. 2008, entitled "LINK ATTACHMENT TO TORQUE WRENCH".

BACKGROUND

The present invention relates to link attachments for torque power tools. Known link attachments usually include pawl-ratchet mechanisms for tightening and loosening of threaded fasteners. It is believed that the existing link attachments can be further improved.

BRIEF SUMMARY OF THE INVENTION

A link attachment 100 for use with a device 300 for effecting an intermittent turning force 360 which oscillates in a forward and a backward direction 361 and 371 for tightening or loosening a fastener including:—

- a link housing 115;
- a link drive input 131 operatively connectable with device 300;
- a link drive lever 102 operatively connected with link drive input 131;
- a link drive plate 101 operatively connected to link drive lever 102 at a pivot point 125 by a link drive pin 105;
- a link ratcheting mechanism 103 operatively connected to link drive lever 102 by a drive pawl 104;
- a link attachment drive output 130 operatively connected with link ratcheting mechanism 103 and operatively connectable with the fastener; and
- link attachment 100 being operatively connectable to device 300 to provide intermittent turning force 360 to turn the fastener.

Advantageously link attachment 100: is operatively connectable to device 300 either by itself or via a drive extension 200; limits the need for movable components in device 100; engages inaccessible fasteners; and magnifies and transfers intermittent turning force 360 to the fastener.

BRIEF DESCRIPTION OF THE DRAWINGS

The invention may be described by way of example only with reference to the accompanying drawings, of which:

FIG. 1A is a top view of link attachment 100 with a link upper housing portion 106 removed;

FIG. 1B is a side view of link attachment 100;

FIG. 2 is a side cross-sectional view of drive extension 200;

FIG. 3 is a side view of device 300;

DETAILED DESCRIPTION OF THE INVENTION

Figure 4A:
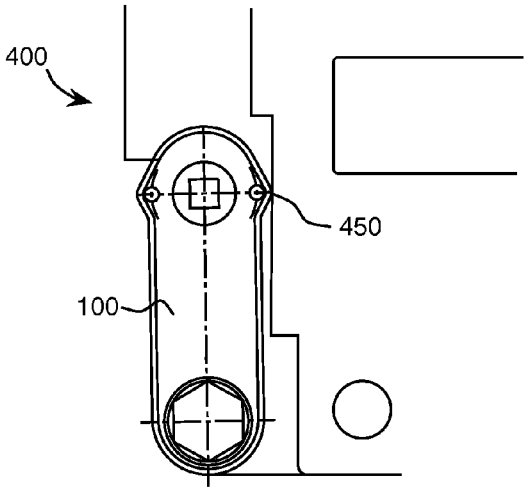
FIGS. 4A and 4B are views of a fastener loosening application 400.

Referring to FIGS. 1A, 1B, 2 and 3, by way of example, link attachment 100 is provided for attachment to device 300 via drive extension 200.

Internal parts of device 300 are not shown in FIG. 3 but typically include the following. A device housing 301 has two housing portions—a device cylinder portion 301A and a device driving portion 301B. A device piston assembly 315 is arranged in device cylinder portion 301A and includes a device cylinder 315A, a device piston 315B reciprocatingly movable in cylinder device 315A along a piston axis A1, and a device piston rod 3150 connected with device piston 315B. A device drive pawl assembly 338 and a device drive plate assembly 339, arranged in device driving portion 301B, are operatively connected to and drivable by device piston assembly 315.

Typically device drive pawl assembly 338 and device drive plate assembly 339 are operatively connected to a device ratchet assembly 340, which includes a device ratchet 325A. Device ratchet 325A is turnable about a turning force axis B1 that is perpendicular to piston axis A1. In this typical formation, device ratchet 325A is connected with a device drive output assembly 330 which receives a first turning force 360 acting about turning force axis B1 in one direction 370 during operation of device 300. Furthermore torque power tools like device 300 include a device reaction pawl assembly 341, which prevents device ratchet assembly 340 from rotating in an opposite, or another, direction 370 during a return stroke of device piston assembly 315.

In the present invention device 300 does not include device reaction pawl assembly 341. Furthermore device ratchet assembly 340 is pinned to a device drive plate assembly 339. During operation of device 300 device drive output assembly 330 oscillates forward and backward from turning force 360 in one direction 370 and another direction 371. Device ratchet 325A does not rotate relative to drive plate assembly 339. Note that turning force 360 may refer to the force created by both a departure stroke and return stroke of piston assembly 315.

Drive extension 200 includes an extension outer reaction assembly 201 operatively and non-rotatably connectable with a device reaction force support assembly 333 of device 300. Extension outer reaction assembly 201 has an extension base plate 203 with extension reaction dowel pins 220 and 221 on either side extending downward. A connecting means, extension drive input assembly 231, is operatively connectable with and rotates with device drive output assembly 330. Connection means 231 may be formed for example as a square drive engagement, but may be formed as any suitable polygonal engagement. An extension inner drive assembly 202 is operatively connected with and rotates with extension drive input assembly 231 and an extension drive output assembly 230. During operation, turning force 360 turns extension inner drive assembly 202 via device drive output assembly 330 during operation of apparatus 1. Extension inner drive assembly 202 correspondingly turns extension drive output assembly 230. Note that drive extension 200 is not necessary for operation of apparatus 1, but may be used to access specific types of fastener tightening or loosening applications.

Device reaction support assembly 333 is formed on a part of and non-rotatably connected with device housing 301. It is formed of an annular polygonal body having a plurality of outer splines positioned circumferentially around the annular body extending radially outwardly from turning force axis B1. Extension outer reaction assembly 201, when attached to reaction support assembly 333, receives second turning force 361, the reaction force, acting in another direction 371 during operation of apparatus 1. Note that turning force 361 may refer to the reaction force created by both a departure stroke and return stroke of piston assembly 315.

Link attachment 100 includes a link housing 115 having a link upper housing portion 106 which corresponds to a fastener-tightening mode and a link lower housing portion 107 which corresponds to a fastener-loosening mode. A connecting means 131, link drive input 131, is operatively connected to a link drive lever 102 and connectable to extension drive output assembly 230 which turn in the same direction as device drive output assembly 330.

During operation, first and second turning forces 360 and 361 are equal to and in opposite directions to each other. Drive extension 200 transfers first turning force 360 from device 300 to link attachment 100 which turns the fastener to be tightened or loosened. Simultaneously extension outer reaction assembly 201 200 transfers second turning force 361 to extension reaction dowel pins 220 and 221. Link attachment 100 includes a connecting means 122, reaction force holes 120 and 121, which accept extension reaction dowel pins 220 and 221. During operation of apparatus 1 device housing 115 does not rotate relative to extension outer reaction assembly 201 or device reaction support assembly 333.

Link drive lever 102 operatively connects with a link drive plate 101 at a pivot point 125 by a link drive pin 105. Link drive plate 101 operatively connects with a spring-loaded seat 126 having a spring 111, a segment 109, and a roll pin 108. A link drive pawl 104 is carried by link drive plate 101 and cooperates with and turns a link ratcheting mechanism 103. Link ratcheting mechanism 103 is rotatably supported in link housing 115, about a turning force axis C1 by engagement with the teeth of the latter. Turning force axis C1 is parallel to turning force axis B1. A connecting means 130, a link attachment drive output 130, is operatively connected with link ratcheting mechanism 103 and operatively connectable with the fastener. Connecting means 130 may be formed for example as a hex fastener engagement, but may be formed as any suitable polygonal engagement.

As shown in FIGS. 1A, 1B, 2 and 3, link ratcheting mechanism 103 advances link attachment drive output 130 in an opposite direction 171 of driving force 360 without allowing it to rotate in one direction 170. Link drive plate 101 resets itself by spring-loaded seat 126, to achieve another forward stroke. During operation apparatus 1 continues tightening the fastener until its final torque is reached. A link output torque 160 in a direction 170 is calculated by multiplying turning force 360 by the moment arm—the distance from pivot point 125 to the center of link ratcheting mechanism 103. Link output torque 160 has an equal and opposite link reaction force 161 which comes from making contact with an abutment pressure point. Link reaction force 161 moves link attachment 100 in opposite direction 171 of turning force 360 located at link attachment drive output 130.

Figure 5A:
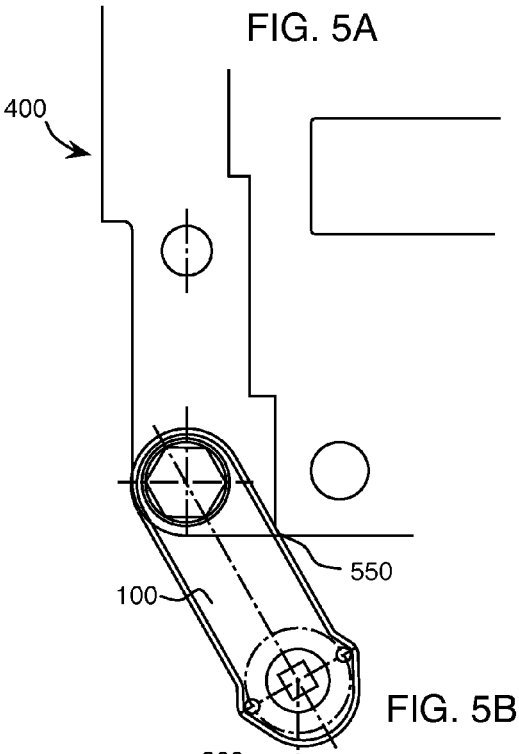
FIGS. 5A and 5B are views of a fastener tightening application 500.
Figure 4B:
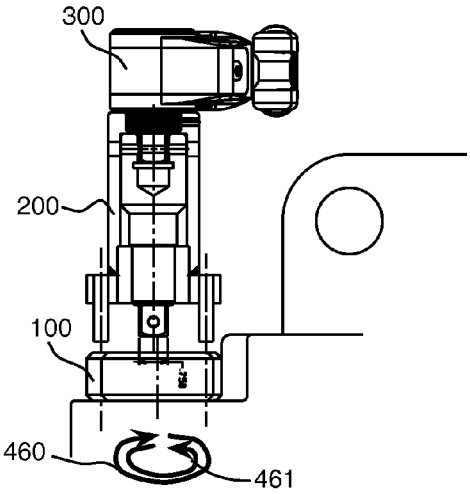
Figure 5B:
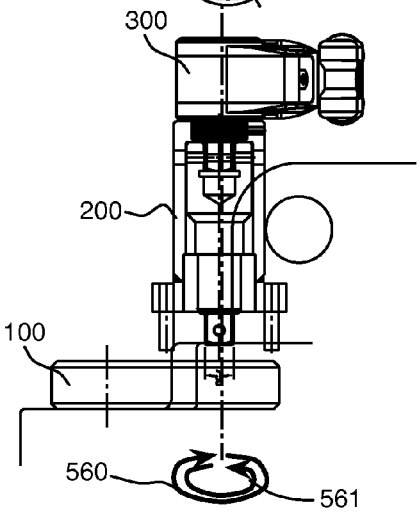

FIGS. 4A and 4B, by way of example, show a fastener loosening application 400 having forces 460 and 461 and an abutment pressure point 450. FIGS. 5A and 5B, by way of example, show a fastener tightening application 500 having forces 560 and 561 and an abutment pressure point 550.

In other words, the present invention includes a hydraulic torque tool, marketed by HYTORC Division UNEX Corporation under the AVANTI® trademark, which is modified so that it does not ratchet. A reaction pawl of the tool is removed and a ratchet of the tool is pinned to drive plates causing the tool to simply oscillate back and forth. The ratchet will no longer spin freely.

A drive extension is then connected to the modified AVANTI® tool. The drive extension allows additional height necessary to reach particular fastener tightening/loosening applications. The drive extension functions by transmitting forces from the tool to the ratchet link, traceable by analyzing the drive torque and reaction torque forces. A square drive of modified AVANTI® tool drives an inner square drive extension. The reaction force from the modified AVANTI® tool is transmitted through a spline adaptor located at the top of the drive extension. These forces move in opposite directions.

The drive torque acts upon a female square of the link attachment causing it to oscillate similar to the square drive of the modified AVANTI® tool. This oscillating motion acts upon a pivot point of the link attachment. The pivot point is connected to a spring loaded drive plate which has its own ratcheting mechanism including a spring, segment, and a ratchet which allows a female hex socket to advance in one direction without returning. The ratcheting mechanism causes the female hex socket to move in the opposite direction of the drive force.

The link attachment resets itself by the spring located in the drive plate. The spring allows the drive plate assembly to return so that it can achieve another forward stroke, thus allowing the apparatus to continue tightening the fastener until final torque is reached. The output torque of the link attachment is created by the drive force, located at the female square, multiplied by the moment arm, the distance from the pivot point to the center of the ratchet 103. This output torque has an equal and opposite reaction force which comes from making contact with an immovable reaction point 350. The reaction force will move the link attachment in the opposite direction of the tightening force which is located at the female hex socket.

It will be understood that each of the elements described above, or two or more together, may also find a useful application in other types of constructions differing from the types described above. The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

While the invention has been illustrated and described as embodied in a fluid operated tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

When used in this specification and claims, the terms "comprising", "including", "having" and variations thereof mean that the specified features, steps or integers are included. The terms are not to be interpreted to exclude the presence of other features, steps or components.

What is claimed is:

1. An apparatus for tightening or loosening a fastener including:— a device 300 for effecting an intermittent turning force 360 which oscillates in a forward and a backward direction 361 and 371;

a link attachment 100 operatively connectable to device 300 providing intermittent turning force 360 to turn the fastener; and a drive extension 200 operatively connectable with device 300 and link attachment 100.

2. An apparatus according to claim 1 wherein link attachment 100 includes:— a link housing 115;

a link drive input 131 operatively connectable with device 300;

a link drive lever 102 operatively connected with link drive input 131;

a link drive plate 101 operatively connected to link drive lever 102 at a pivot point 125 by a link drive pin 105;

a link ratcheting mechanism 103 operatively connected to link drive lever 102 by a drive pawl 104;

a link attachment drive output 130 operatively connected with a link ratcheting mechanism 103 and operatively connectable with the fastener.

3. An apparatus according to claim 2 wherein link drive input 131 oscillates forward and backward thereby advancing link drive output 130 in one direction via link ratcheting mechanism 103.

4. An apparatus according to claim 2 wherein link attachment 100 includes a link upper housing portion 106 which corresponds to tightening of the fastener and a link lower housing portion 107 which corresponds to loosening of the fastener.

5. An apparatus according to claim 1 wherein device 300 includes:— a device housing 301;

a device piston assembly 315;

a device drive pawl assembly 338 operatively connected with piston assembly 315;

a device drive plate assembly 339 operatively connected with drive pawl assembly 338;

a device ratchet assembly 340 operatively connected with drive plate assembly 339;

a device drive output assembly 330; and a device reaction support assembly 333.

6. An apparatus according to claim 1 wherein drive extension 200 includes:— an extension outer reaction assembly 201 operatively connectable with device reaction support assembly 333, extension outer reaction assembly 201 having an extension base plate 203 with extension reaction pins 220 and 221;

an extension drive input assembly 231 operatively connectable with device drive output assembly 330;

an extension inner drive assembly 202 operatively connected with extension drive input assembly 231; and an extension drive output assembly 230.

7. An apparatus according to claim 1 wherein link attachment 100 includes link reaction force holes 120 and 121 for extension reaction pins 220 and 221.

8. An apparatus according to claim 1 wherein device 300 does not include a device reaction pawl assembly 341 which allows operative portions of device 300 to oscillate forward and backward.

9. An apparatus according to claim 1 wherein device 300 provides coaxial action and reaction turning forces 360 and 361 in opposite directions 370 and 371 at substantially equal torque.

10. An apparatus according to claim 1 wherein link attachment 100 includes means for abutting against a nearby stationary object to prevent torque power tool 300 from turning around the fastener.

11. An apparatus according to claim 1 wherein link attachment 100 magnifies action turning force 360.

12. An apparatus according to claim 1 wherein device reaction turning force 361, which tries to tilt link attachment 100, is overcome by link action and reaction forces 160 and 161, which are superior and also perpendicular to device action and reaction turning forces 360 and 361, so that link attachment 100 remains in line with the fastener and a nearby stationary object.

13. An apparatus according to claim 1 wherein link attachment 100 is connectable to and disconnectable from device 300 as a unit.

14. A link attachment 100 for use with a device 300 for effecting an intermittent turning force 360 which oscillates in a forward and a backward direction 361 and 371 for tightening or loosening a fastener including:— a link housing 115;

a link drive input 131 operatively connectable with device 300;

a link drive lever 102 operatively connected with link drive input 131;

a link drive plate 101 operatively connected to link drive lever 102 at a pivot point 125 by a link drive pin 105;

a link ratcheting mechanism 103 operatively connected to link drive lever 102 by a drive pawl 104;

a link attachment drive output 130 operatively connected with link ratcheting mechanism 103 and operatively connectable with the fastener;

link attachment 100 being operatively connectable to device 300 to provide intermittent turning force 360 to turn the fastener; and a drive extension 200 operatively connectable with device 300 and link attachment 100.

15. A link attachment according to claim 14 wherein device 300 includes:— a device housing 301;

a device piston assembly 315;

a device drive pawl assembly 338 operatively connected with piston assembly 315;

a device drive plate assembly 339 operatively connected with drive pawl assembly 338;

a device ratchet assembly 340 operatively connected with drive plate assembly 339;

a device drive output assembly 330; and a device reaction support assembly 333.

16. A link attachment according to claim 14 wherein drive extension 200 includes:— an extension outer reaction assembly 201 operatively connectable with device reaction support assembly 333, extension outer reaction assembly 201 having an extension base plate 203 with extension reaction pins 220 and 221;

an extension drive input assembly 231 operatively connectable with device drive output assembly 330;

an extension inner drive assembly 202 operatively connected with extension drive input 231 assembly; and an extension drive output assembly 230.

17. A link attachment according to claim 14 wherein link attachment 100 includes link reaction force holes 120 and 121 for extension reaction pins 220 and 221.

18. A link attachment according to claim 14 wherein device 300 does not include a drive reaction pawl assembly 341 which allows operative portions of device 300 to oscillate forward and backward.

19. A link attachment according to claim 14 wherein link drive input 131 oscillates forward and backward thereby advancing link drive output 130 in one direction via link ratcheting mechanism 103.

20. A link attachment according to claim 14 wherein link attachment 100 includes a link upper housing portion 106 which corresponds to tightening of the fastener and a link lower housing portion 107 which corresponds to loosening of the fastener.

21. A link attachment according to claim 14 wherein device 300 provides coaxial action and reaction turning forces 360 and 361 in opposite directions 370 and 371 at substantially equal torque.

22. A link attachment according to claim 14 wherein link attachment 100 includes means for abutting against a nearby stationary object to prevent torque power tool 300 from turning around the fastener.

23. A link attachment according to claim 14 wherein link attachment 100 magnifies action turning force 360).

24. A link attachment according to claim 14 wherein device reaction turning force 361, which tries to tilt link attachment 100, is overcome by link action and reaction forces 160 and 161, which are superior and also perpendicular to device action and reaction turning forces 360 and 361, so that link attachment 100 remains in line with the fastener and a nearby stationary object.

25. A link attachment according to claim 14 wherein link attachment 100 is connectable to and disconnectable from device 300 as a unit.

26. A link attachment according to claim 14 wherein drive plate 101 sits on a spring loaded seat 126.

* * * * *